US006211121B1

(12) United States Patent
Willis

(10) Patent No.: US 6,211,121 B1
(45) **Date of Patent: *Apr. 3, 2001**

(54) WATER GLYCOL TREATMENT WITH POLYTETRAFLUOROETHYLENE

(76) Inventor: John Dale Willis, 1222 Merlyn St., Lakeland, FL (US) 33813

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/224,066

(22) Filed: Dec. 31, 1998

Related U.S. Application Data

(60) Provisional application No. 60/070,222, filed on Dec. 31, 1997, now abandoned.

(51) Int. Cl.[7] ..... C10M 129/08; C10M 147/00

(52) U.S. Cl. ..... 508/181; 508/182; 508/183

(58) Field of Search ..... 508/181, 182, 508/183

(56) References Cited

FOREIGN PATENT DOCUMENTS 58-037094 * 3/1983 (JP) .
08060175 * 3/1996 (JP) .

* cited by examiner

*Primary Examiner*—Margaret Medley
*Assistant Examiner*—Cephia D. Toomer
(74) *Attorney, Agent, or Firm*—Lyon P.C.

(57) ABSTRACT

A lubricant contains a fire-resistant water/glycol mixture combined with polytetrafluoroethylene, and is useful in the hydraulic systems of die casting machines, for example. The addition of polytetrafluoroethylene enhances the lubricity of fire-resistant hydraulic fluids thereby reducing the associated equipment maintenance.

15 Claims, No Drawings

WATER GLYCOL TREATMENT WITH POLYTETRAFLUOROETHYLENE

CROSS REFERENCE TO RELATED APPLICATIONS

This application claims the benefit of U.S. Provisional Application No. 60/070,222 filed on Dec. 31, 1997, now abandoned.

FIELD OF THE INVENTION

This invention relates to a fire-resistant lubricant designed for use within high temperature environments such as die casting machines.

BACKGROUND OF THE INVENTION

In many industrial forming processes, such as the molding, die casting, drawing, and forging of various metals or other similar materials, it is necessary to apply a lubricant to the working surfaces of such dies or other forming apparatus between machine-cycle operations. Further, the application of air and lubricants to the working surfaces tends to cool the dies between operational cycles thereby prolonging the life of the dies.

Industrial processes such as die casting often subject hydraulic systems to extremely high temperatures. In the past, many die casting operations used well-known hydraulic fluids as lubricants, despite their flammability. Given the safety considerations, conventional hydraulic fluids within high temperature hydraulic applications were replaced with nonflammable water/diethylene glycol or water/ethylene glycol mixtures. Although nonflammable, water glycol mixtures exhibit poor lubricity properties thereby resulting in equipment failure and escalating maintenance costs due to friction wear.

Conventional fixed and movable die casting molds are substantially formed from heat resistant metal. In a typical die casting process, a piston slidably moves within an injection sleeve causing molten metal contained therein to be injected and filled into a mold assembly. Over time, the hydraulic equipment and molds sustain repeated thermal shocks caused by heat transfer from the hot molten metal often ranging from about 600 to 1650 degrees Celsius. In the absence of an effective lubricant, the molds rapidly erode and fracture resulting in a complete crack or breakage. The hydraulic equipment is subject to the same stresses and will certainly require frequent maintenance in the absence of an effective lubricant. Properties such as the tensile strength and fatigue-resistance are detrimentally affected thereby reducing the life of the equipment.

The surfaces of the die cast molds typically require maintenance after several cycles since the surfaces gradually wear out through constant use. When maintenance is required, the entire die cast frame must be disassembled to facilitate removal of the molds. This is typically a very time-consuming operation resulting in an idle production line. The time spent to maintain the die therefore reduces the production time.

It would therefore be an improvement to provide a fire-resistant fluid having enhanced lubricating and cooling properties.

SUMMARY OF THE INVENTION

The present invention solves the aforesaid problems by forming an industrial fluid useful as a hydraulic and/or lubricating fluid, wherein the industrial fluid contains a lubricating additive combined with nonflammable water/glycol mixtures. The lubricating additive includes water/glycol fluids blended with an aqueous solution of polytetrafluoroethylene (hereinafter PTFE). PTFE is generally provided as either a granular, micropowder, or aqueous substance. Applicant has further discovered that due to its higher density, the PTFE aqueous solution when compared to granular or powdered PTFE, forms a denser and more effective lubricant between opposing interfaces.

In accordance with the present invention, a preferred embodiment comprises aqueous PTFE containing about 50–60% PTFE and about 33–50% water, wherein the aqueous PTFE constitutes about 0.2 to 5% by weight of the total lubricant. The preferred lubricating additive further contains, in weight percentages, a glycol-based fire-resistant fluid at about 75–95%, a dispersant at about 2–10%, a first surfactant at about 2–12%, a second surfactant having nonionic character at about 0.25–6%, and a defoaming agent at about 0.1–4%.

DESCRIPTION OF THE PREFERRED EMBODIMENT(S)

In accordance with the present invention, a fire resistant water/glycol fluid is mixed with PTFE thereby resulting in a fire-resistant lubricant to be added to a bulk water/glycol hydraulic fluid. The composition also contains a surface active agent functioning as a dispersant and a wetting agent, and if desired, may contain a first surfactant, a second nonionic surfactant, and a defoaming agent.

The water/glycol fluid generally contains a glycol-based fluid at about 40–60% by weight, and water at about 40–60% by weight. The glycol-based fluid includes but is not limited to a fluid selected from diethylene glycol or ethylene glycol.

In accordance with the present invention, polytetrafluoroethylene is added to significantly improve the lubricity properties of the hydraulic fluid. Polytetrafluoroethylene is commercially available as a granulated solid, a powdered solid, and as an aqueous dispersion. When aqueously dispersed, PTFE constitutes about 50–60% of the aqueous dispersion, and water constitutes about 33–50% of the aqueous dispersion. In further accordance with the present invention, applicant has discovered that the use of aqueous PTFE results in better mixing of the suspended PTFE and therefore enhances the lubricity of the final product. Stated another way, the particle size of the suspended PTFE in the aqueous dispersion is significantly smaller than that of the micropowder type. In We aqueous dispersion, PTFE particles range in size from 0.05 to 0.5 microns. As a micropowder, the average size of the PTFE particles is about 2 microns. The smaller particles within the aqueous dispersion more readily fill the vacant interstices of the molecular matrices when mixed with the hydraulic fluid. As a result, mixing aqueous PTFE into the hydraulic fluid results in a denser lubricant as compared to the granulated and powdered PTFE. However, one of ordinary skill in the art will readily appreciate that mixing in powdered or granulated PTFE will still provide enhanced lubricating properties within the hydraulic fluid. The aqueous PTFE solution, comprising 50–60% of suspended PTFE, is provided at about 0.2–5% by weight of the total lubricant. Therefore, when adding solid PTFE, the total amount should constitute about 0.1%–3 by weight of the total lubricant. If desired, up to 3–10% by weight of solid PTFE may be added to account for the reduction in PTFE density as described above.

The dispersant, the first surfactant, and the second nonionic surfactant are each selected from well-known additives useful as surface active agents. These include suspending agents, dispersing agents, wetting agents, and emulsifying agents. Surface active agents, often multifunctional, are employed in the aqueous system to assist in wetting the operating surfaces of the applicable equipment. They are also used to disperse, suspend, or emulsify water insoluble components, such as PTFE, and to evenly apply the lubricant to the equipment operating surfaces. Many examples of surface active agents of each type are disclosed in McCutcheons's *Detergents and Emulsions,* 1982, incorporated herein by reference U.S. Pat. No. 4,454,050, incorporated herein by reference, also discloses examples of surface active agents. Surface active agents, useful in homogeneously dispersing the PTFE throughout the hydraulic fluid, are also selected based on their respective wetting, suspending, and emulsifying properties. Triethanolamine, for example, is known for its use as a dispersant, a chelating agent, an emulsifier, and as a detergent or wetting agent. Nevertheless, preferred lubricants of the present invention include additional surfactants and a defoaming agent as described below.

Other additives such as thickeners, germicides, corrosion inhibitors, dyes, and perfumes may be added as taught in U.S. Pat. No. 4,454,050.

The lubricant compositions may be formulated as follows. A vessel equipped with a stirrer and with either internal or exterior heating and cooling is preferred. Stainless steel is a preferred metal for the mixing vessel. The vessel is first charged with the water/glycol hydraulic fluid. Next, the dispersant is slowly and homogeneously added. If desired, the first surfactant is next slowly and homogeneously added. Again, if desired, the second nonionic surfactant is slowly and homogeneously added. Next, the polytetrafluoroethylene is slowly and homogeneously added. Finally, if desired, the defoaming agent is slowly and homogeneously added. Other additives such as thickeners, germicides, corrosion inhibitors, dyes, and perfumes may then be added if desired. While mixing the ingredients, the temperature is allowed to rise to its natural level, and, if necessary heat is applied to facilitate more efficient mixing.

Specifically, a preferred mixture is formed by slowly, evenly, and sequentially mixing the following compounds in the order and weight percentage ranges (of the total lubricant) given:

| Compounds | Wt. % Range |
|---|---|
| about 40–60 wt. % diethylene glycol admixed with 40–60 wt. % water as a water/glycol fluid; | about 75% to 95% |
| triethanolamine as a dispersant; | about 2% to 10% |
| oleyl alcohol polyethoxylate, phosphate ester as a first surfactant; | about 2% to 12% |
| octylphenoxypolyethoxyethanol as a second nonionic surfactant; | about .25% to 6% |
| about 60 wt. % PTFE admixed with 33 wt. % water; | about .2% to 5% |
| about 6 wt. % polypropylene glycol admixed with about 2 wt. % polydimethylsiloxane and 90 wt. % water as a defoaming agent. | about .1% to 4% |

The water/glycol fluid may be purchased, for example, under the trade name of "HOUGHTO-SAFE 419-R" from Houghton International Inc. of Valley Forge, Pa. HOUGHTO-SAFE 419R contains about 40% diethylene glycol and 45% water. The triethanolamine may be purchased, for example, from Ashland Chemical Co. of Colombus, Ohio. The oleyl alcohol polyethoxylate, phosphate ester may be purchased, for example, under the trade name of "LUBRHOPHOS LB-400" from Ashland Chemical Co. of Colombus, Ohio. The octylphenoxypolyethoxyethanol may be purchased, for example, under the trade name "TRITON X-100" from Union Carbide Corporation of Danbury, Conn. The aqueous solution of PTFE may be purchased, for example, under the trade name of "TEFLON 30" from E.I. Dupont of Wilmington, Del. Finally, the defoaming agent may be purchased, for example, under the trade name "DOW CORNING(R) ANTIFOAM 2210" from Dow Corning Corporation of Midland, Mich.

After mixing is complete, the lubricating additive is now suitable for ultimate mixing with a water/glycol hydraulic fluid useful within a die casting machine, for example. The lubricating additive is generally mixed at about one part of additive to twelve parts of water/glycol hydraulic fluid, but may be tailored based on performance criteria. The addition of the PTFE lubricant has been found to significantly reduce friction and therefore prolong the life of the hydraulic cylinders and pumps. Furthermore, the energy required to operate the hydraulically actuated equipment is significantly reduced when the PTFE lubricant is added.

While the preferred embodiment of the invention has been disclosed, it should be appreciated that the invention is susceptible of modification without departing from the scope of the following claims.

I claim:

1. A lubricating additive useful in hydraulic and lubricating fluids comprising a fluid mixture of:

a fire-resistant fluid containing about 40–60% by weight of a glycol-based constituent, wherein the fire-resistant fluid comprises 75–95% by weight of said lubricating additive;

polytetrafluoroethylene provided at about 0.1–10% of said lubricating additive; and a dispersant provided at about 2–10% of said lubricating additive.

2. The lubricating additive of claim 1 wherein:

polytetrafluoroethylene comprises 0.1–3% by weight of said lubricant; and the dispersant comprises about 2–10% by weight of said lubricant.

3. The lubricating additive of claim 1 further comprising:

a first surfactant comprising about 2–12% by weight of said lubricating additive; and a nonionic second surfactant comprising about 0.25–6% by weight of said lubricating additive.

4. The lubricating additive of claim 1 further comprising:

an antifoam agent comprising about 0.1–4% by weight of said lubricating additive.

5. The lubricating additive of claim 1 wherein:

the polytetrafluoroethylene is provided as an aqueous dispersion comprising about 50–60% polytetrafluoroethylene and about 33–50% of water.

6. A lubricant comprising a mixture of:

a water/glycol fluid comprising about 40–60% by weight of diethylene glycol and about 40–60% by weight of water, wherein the fluid comprises about 75–95% by weight of said lubricant;

polytetrafluoroethylene comprising about 0.1–10% by weight of said lubricant; and triethanolamine.

7. The lubricant of claim 6 wherein:

triethanolamine comprises about 2–10% by weight of said lubricant; and polytetrafluoroethylene comprises about 0.1–3% by weight of said lubricant.

8. The lubricant of claim 6 further comprising:

oleyl alcohol polyethoxylate, phosphate ester comprising about 2–12% by weight of said lubricant; and octylphenoxypolyethoxyethanol comprising about 0.25–6% by weight of said lubricant.

9. The lubricant of claim 6 further comprising:

a defoaming agent comprising about 2% polydimethylsiloxane, about 6% polypropylene glycol, and about 90% water, wherein the defoaming agent comprises about 0.1–4% by weight of said lubricant.

10. The lubricant of claim 6 wherein:

the polytetrafluoroethylene is provided as an aqueous dispersion containing about 50–60% by weight of polytetrafluoroethylene and about 33–50% by weight of water.

11. A liquid lubricant consisting of a mixture of:

a fire-resistant fluid containing about 40–60% by weight of a glycol-based constituent, wherein the fluid comprises 75–95% by weight of said lubricant;

polytetrafluoroethylene comprising 0.1–10% by weight of said lubricant; and a dispersant.

12. A liquid lubricant consisting of a mixture of:

a fire-resistant fluid containing about 40–60% by weight of a glycol-based constituent, wherein the fluid comprises 75–95% by weight of said lubricant;

polytetrafluoroethylene comprising 0.1–10% by weight of said lubricant;

a dispersant; and a first surfactant comprising about 2–12% by weight of said lubricant.

13. A liquid lubricant consisting of a mixture of:

a fire-resistant fluid containing about 40–60% by weight of a glycol-based constituent, wherein the fluid comprises 75–95% by weight of said lubricant;

polytetrafluoroethylene comprising 0.1–10% by weight of said lubricant;

a dispersant;

a first surfactant comprising about 2–12% by weight of said lubricant; and a second surfactant comprising about 0.25–6% by weight of said lubricant.

14. A liquid lubricant consisting of a mixture of:

a fire-resistant fluid containing about 40–60% by weight of a glycol-based constituent, wherein the fluid comprises 75–95% by weight of said lubricant;

polytetrafluoroethylene comprising 0.1–10% by weight of said lubricant;

a dispersant;

a first surfactant comprising about 2–12% by weight of said lubricant;

a second surfactant comprising about 0.25–6% by weight of said lubricant, and an antifoam agent comprising about 0.1–4% by weight of said lubricant.

15. In an industrial fluid useful as a hydraulic and/or lubricating fluid and comprising a water/glycol mixture, the improvement comprising:

a lubricating additive containing a fire-resistant fluid containing about 40–60% by weight of a glycol-based constituent, wherein the fire-resistant fluid comprises 75–95% by weight of said lubricating additive;

polytetrafluoroethylene provided at about 0.1–10% of said lubricating additive; and a dispersant provided at about 2–10% of said lubricating additive.

* * * * *